US005655594A

United States Patent [19]

Wonderling

[11] Patent Number: 5,655,594

[45] Date of Patent: Aug. 12, 1997

[54] ROTARY REGENERATIVE HEAT EXCHANGER

[75] Inventor: Michael W. Wonderling, Scio, N.Y.

[73] Assignee: ABB Air Preheater, Inc., Wellsville, N.Y.

[21] Appl. No.: 529,222

[22] Filed: Sep. 15, 1995

[51] Int. Cl.[6] ..... F23L 15/02

[52] U.S. Cl. ..... 165/9; 165/8

[58] Field of Search ..... 165/9, 8, 6, 10

[56] References Cited

U.S. PATENT DOCUMENTS

| | | | |
|---|---|---|---|
| 2,607,565 | 8/1952 | Jensen | 165/9 |
| 2,692,760 | 10/1954 | Flurschutz | 165/9 |
| 2,740,614 | 4/1956 | Hammond et al. | 165/9 |
| 2,761,654 | 9/1956 | Valvo | 165/9 |
| 2,803,508 | 8/1957 | Nilsson et al. | 165/9 |
| 2,821,367 | 1/1958 | Muller | 165/9 |
| 3,545,532 | 12/1970 | Waitkus | 165/9 X |
| 3,587,723 | 6/1971 | Norback | 165/9 X |
| 3,800,859 | 4/1974 | Norback | 165/9 X |
| 4,997,028 | 3/1991 | Townsend | 165/9 |
| 5,137,078 | 8/1992 | Borowy | 165/9 |

FOREIGN PATENT DOCUMENTS

| | | | |
|---|---|---|---|
| 615765 | 3/1961 | Canada | 165/10 |
| 662712 | 5/1963 | Canada | 165/9 |
| 702962 | 1/1954 | United Kingdom | 165/9 |

*Primary Examiner*—John Rivell
*Assistant Examiner*—Christopher Atkinson
*Attorney, Agent, or Firm*—Chilton, Alix & Van Kirk

[57] ABSTRACT

The connecting plate duct assemblies which form the inlet and outlet ducts for a rotary regenerative air preheater have a horizontal flange plate around the periphery. The vertical panels which house the rotor sit on the lower horizontal flange plate and are attached to lower vertical attachment bars extending up from the lower horizontal flange plate. The upper ends of the vertical housing panels are spaced below the upper horizontal flange plate and abut upper vertical attachment bars extending down from the upper horizontal flange plate. The upper ends of the vertical housing panels are welded to these upper vertical attachment bars to hold them in position and to seal the space. Sealing means are provided between the vertical housing panels and the rotor at both the upper and lower ends.

7 Claims, 4 Drawing Sheets

ROTARY REGENERATIVE HEAT EXCHANGER

BACKGROUND OF THE INVENTION

The present invention relates to rotary regenerative heat exchangers and more particularly to the vertical housing panels and the connection between these panels and the horizontal flange plate on connecting duct assemblies.

A rotary regenerative heat exchanger, conventionally used as an air preheater for combustion equipment, is composed of a rotor containing heat exchange surface which is mounted on a vertical shaft for rotation within a heat exchanger housing which surrounds the rotor. Extending across the lower end of the heat exchanger, normally the cold end, below the housing is a cold end center section which serves as a support for the entire heat exchanger structure including the rotor. Extending across the top of the heat exchanger above the housing and parallel to the cold end center section is a hot end center section. This hot end center section functions as the mounting means for the upper end of the rotor shaft. The hot end center section is supported by main support pedestals on each end of the hot end center section which are, in turn, supported on the ends of the cold end center section.

The housing comprises a plurality of vertical housing panels arranged around the periphery of the rotor. Typically, there are eight or more such panels that form the housing. Attached to each end of the heat exchanger are the connecting plate duct assemblies. There are connections which make the transition between the duct work, which is usually rectangular, and the generally circular heat exchanger and they are attached to the sides of the hot and cold end center sections. The vertical housing panels are attached to and between these connecting plate duct assemblies thereby forming the housing around the rotor and forming the flow path for the air and gas through the rotor. In the normal arrangement, circumferential bypass seals are provided between the rotor and the housing, or the connecting plate duct assemblies to which the housing is attached, to prevent the air and gas from flowing around the outside of the rotor.

In prior art rotary regenerative heat exchangers, the vertical housing panels are formed with flanges on each end. The flange on the bottom of each panel is bolted to a mating horizontal flange plate attached to the cold end connecting plate duct assemblies. Likewise, the flange on the top of each panel is bolted to a mating horizontal flange plate on the hot end connecting plate duct assemblies. In order to assure the fit of the vertical housing panels between the mating flanges on the connecting plate duct assemblies, the vertical housing panels must be manufactured to length within rather close tolerances. This tolerance normally provides for a small designed-in gap between the top flange of the vertical housing panels and the mating flange on the connecting plate duct assemblies. During the field assembly, the alignment holes for the bolts that fasten the vertical housing panels to the horizontal flanges on the connecting plate duct assemblies are hand drilled. After field assembly when these flanges are bolted together, a round rod is welded or otherwise attached around the outside of the gap to form a seal.

SUMMARY OF THE INVENTION

The present invention involves an improved design of vertical housing panels for a rotary regenerative heat exchanger and particularly involves an improved connection between the vertical housing panels and the horizontal flange plate of the connecting plate duct assemblies which does not require close tolerances for the length of the vertical housing panels and which does not require bolting. The invention involves the use of vertical attachment bars which are welded to the horizontal flange plates on the connecting plate duct assemblies. The vertical housing panels butt against and overlap these vertical attachment bars and are welded in place. Because there is a significant overlap, the tolerance for the length of the vertical housing panels is no longer critical. Also, the field drilling of alignment holes and the bolting operation are no longer required.

DESCRIPTION OF THE PREFERRED EMBODIMENT

Figure 1:
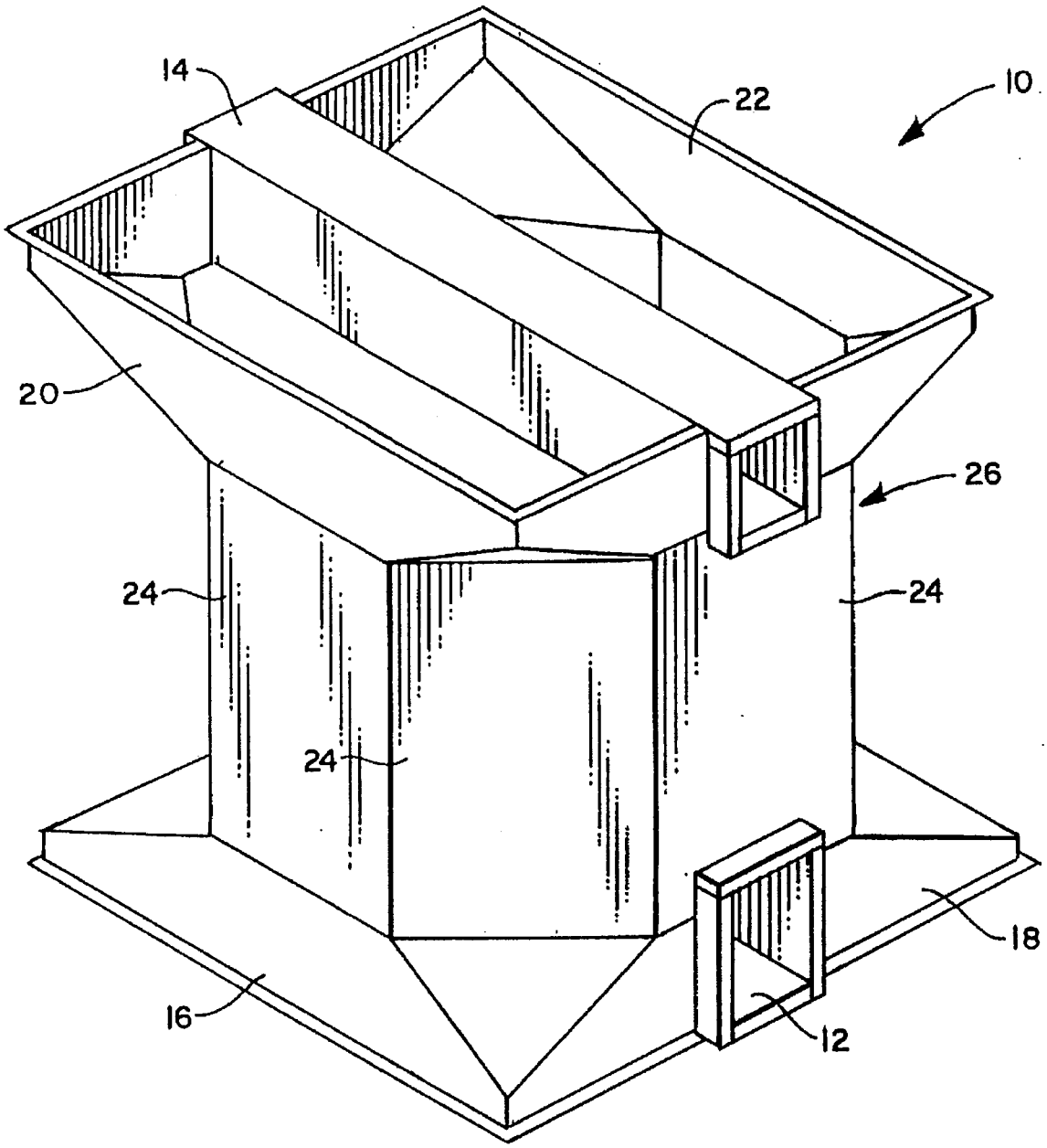
FIG. 1 is a general perspective view of a rotary regenerative air preheater.

FIG. 1 of the drawings is a perspective view of a rotary regenerative air preheater 10 generally illustrating the type of heat exchanger to which the present invention applies. Forming the base of the unit is the cold end center section 12 which is constructed in the conventional manner known in the art and comprises structural steel support beams and the associated support members (not shown in detail) to form the support frame. The rotor of the air preheater (not shown in FIG. 1) is rotatably supported on this cold end center section 12. Such rotors may be as large as 65 feet in diameter and 10 feet high and they are tightly packed with heat exchange surface. The upper end of the rotor is supported by the hot end center section 14.

Mounted on the sides of the cold end center section 12 are the cold end connecting plate duct assemblies 16 and 18. As previously indicated, these form the connections and the transition between the duct work of the steam generator and the generally circular housing of the air preheater. Mounted on the sides of the hot end center section 14 are the hot end connecting plate duct assemblies 20 and 22. Like the cold end connecting plate duct assemblies 16 and 18, these form the connections and transition between the duct work and the air preheater housing. Attached to and extending between the hot and cold connecting plate duct assemblies are the vertical housing panels 24 which make up the rotor housing generally designated as 26. In this illustration, there are eight vertical housing panels but there may be more, particularly in very large air preheaters.

Figure 2:
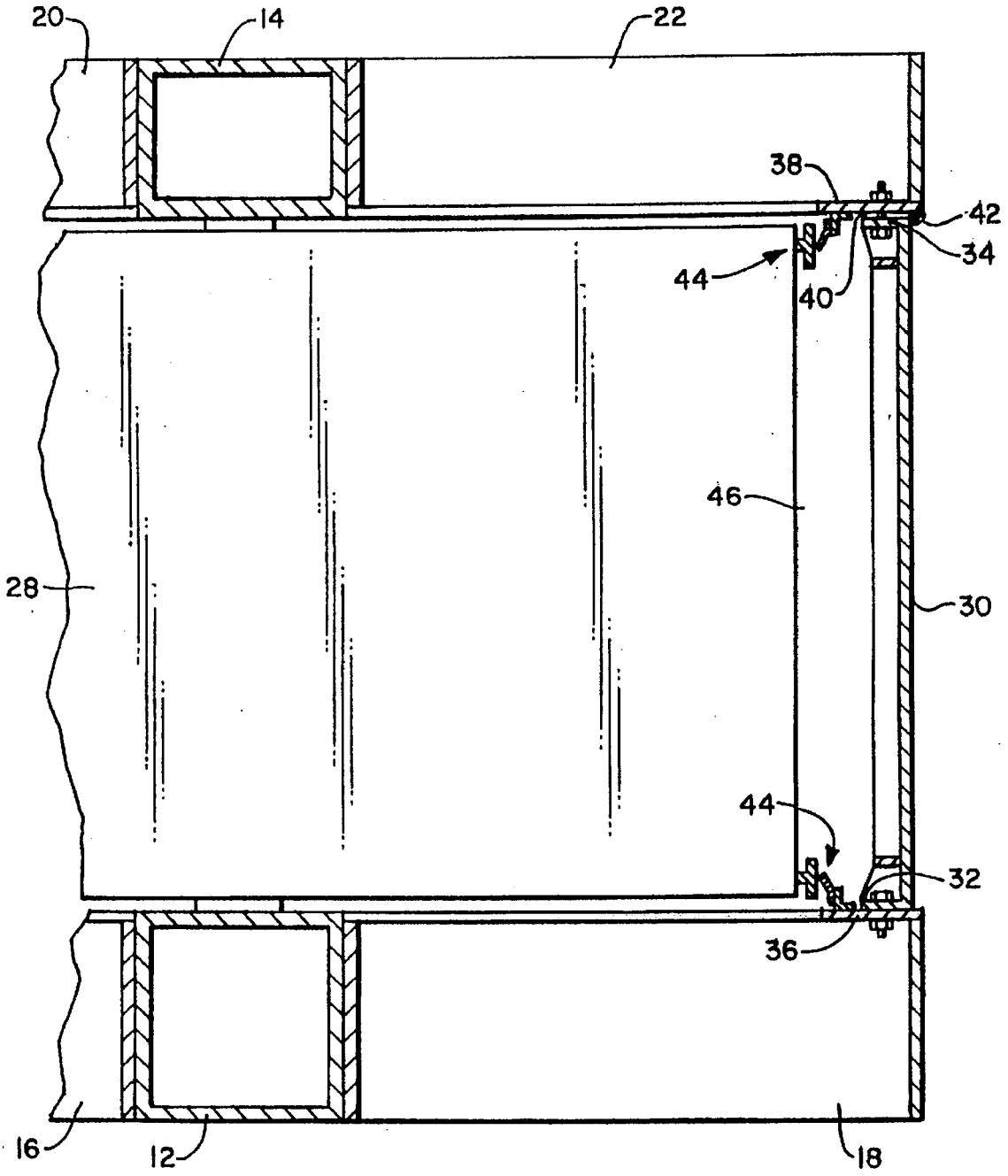
FIG. 2 PRIOR ART
FIG. 2 is a cross-section side view of a portion of a rotary regenerative heat exchanger illustrating the prior art arrangement of vertical housing panels.

As indicated, this FIG. 1 merely illustrates the general arrangement of an air preheater. A more detailed illustration of the arrangement of the vertical housing panels and their connection to the connecting plate duct assemblies in prior art air preheaters is shown in FIG. 2. The cold end center section 12 and the hot end center section 14 are shown in cross-section in a simplified form, excluding all the internal structural details. Attached to the sides of the cold end center section 12 are the cold end connecting plate duct assemblies 16 and 18 and the hot end connecting plate duct assemblies 20 and 22 are attached to the sides of the hot end center section 14. The rotor 28 is rotatably mounted between the cold and hot end center sections.

This FIG. 2 illustrates a typical prior art rotor housing arrangement wherein the vertical housing panels (24 in FIG. 1) each comprise a vertical panel 30 (shown in cross-section in FIG. 2) with flanges 32 and 34 on the bottom and top edges respectively. The flange 32 is bolted at appropriate intervals to the horizontal flange plate 36 which is around the periphery of the cold end connecting plate duct assembly 18. The top flange 34 on the top of the vertical housing panel 30 is likewise bolted to the horizontal flange plate 38 around the periphery of the hot end connecting plate duct assembly 22. The vertical housing panel 30 is formed to a specified length within certain tolerances so as to leave the designed-in gap 40 between the flanges 38 and 40. This assures that the vertical housing panels will fit between the flanges 36 and 38. In the field assembly of these large air preheaters, the panels are placed into position and then bolt holes are drilled in the thick flanges 32, 34, 36 and 38 so as to accurately align the panels. This requires a significant manpower expense. Furthermore, once the panels have all been bolted in position, it is necessary to install the round rod 42, such as by welding, to close off the gap 40. Also shown in this FIG. 2 are the bypass seals generally designated as 44. These bypass seals are mounted between the bottom and top edges of the rotor 28 and the flanges 36 and 38 at the bottom and top respectively to prevent the bypass of air and gas around the rotor 28 in the space 46 between the rotor 28 and the vertical housing panels 30. Although the bypass seals of the present invention are mounted differently than depicted in FIG. 2, the details of the seal itself are very similar and will be described hereinafter in connection with the present invention.

Figure 3:
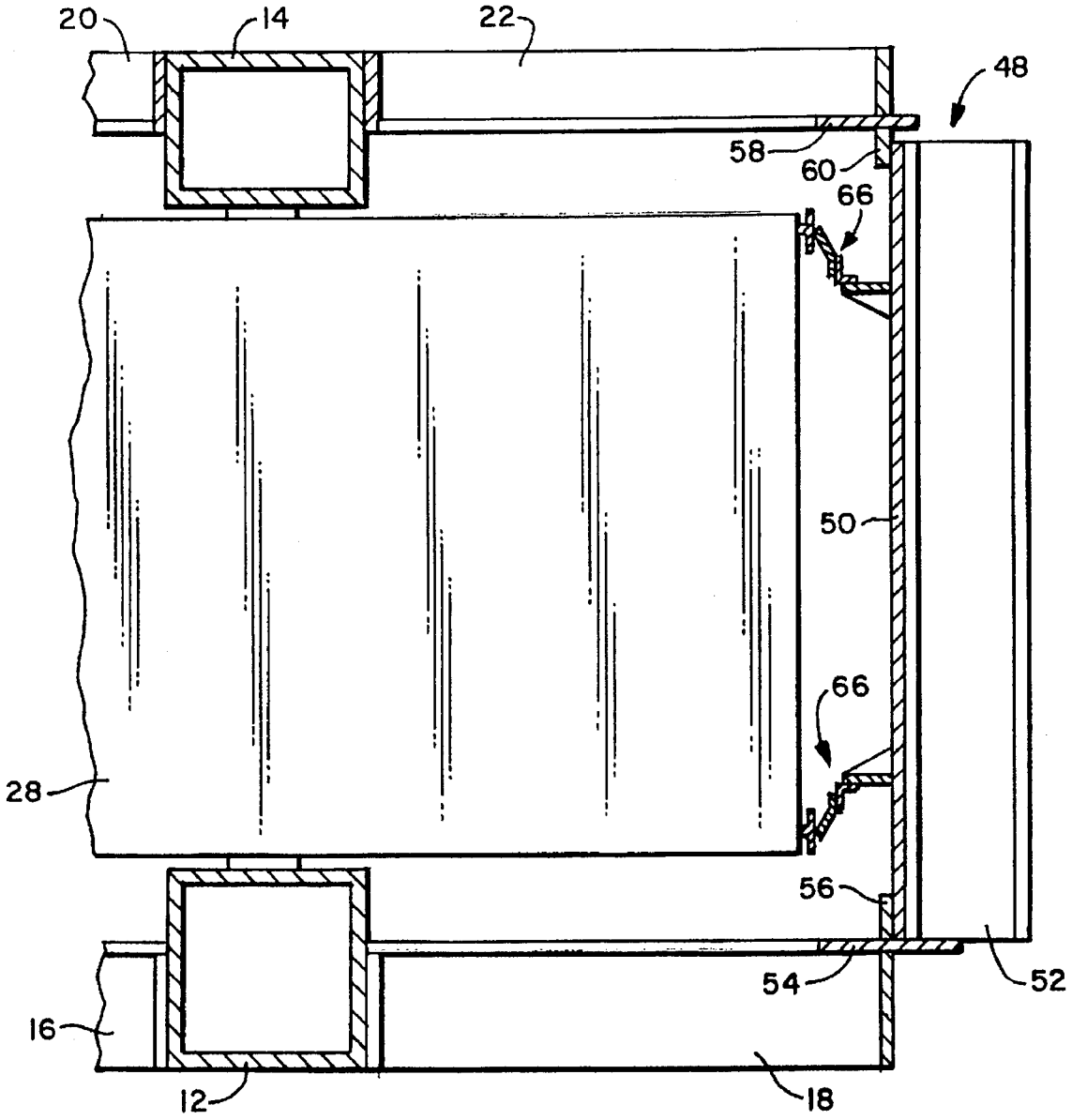
FIG. 3 is a similar cross-section side view of a portion of a rotary regenerative heat exchanger illustrating the vertical housing panels of the present invention.

FIG. 3 is a cross-section view similar to FIG. 2 but illustrating the vertical housing panels 48 of the present invention. These panels comprise the flat panel face plate 50, facing the rotor, and the reinforcing structural members 52 attached to the plate 50 at appropriate intervals on the outside. These members 52 are illustrated as being in the form of I-beams but other shapes could just as readily be used.

The vertical housing panels 48 of the present invention are installed by placing them in position resting on the horizontal panel support flange 54 which is installed around the periphery of the cold end connecting plate duct assemblies 16 and 18 similar to the flanges 36 of the prior art shown in FIG. 2. Welded to the flange 54 are a series of vertical alignment bars 56 which extend upwardly from the flange 54 all around the periphery. The vertical housing panel 48 butts against the alignment bar 56 and is welded to the bar.

Figure 4:
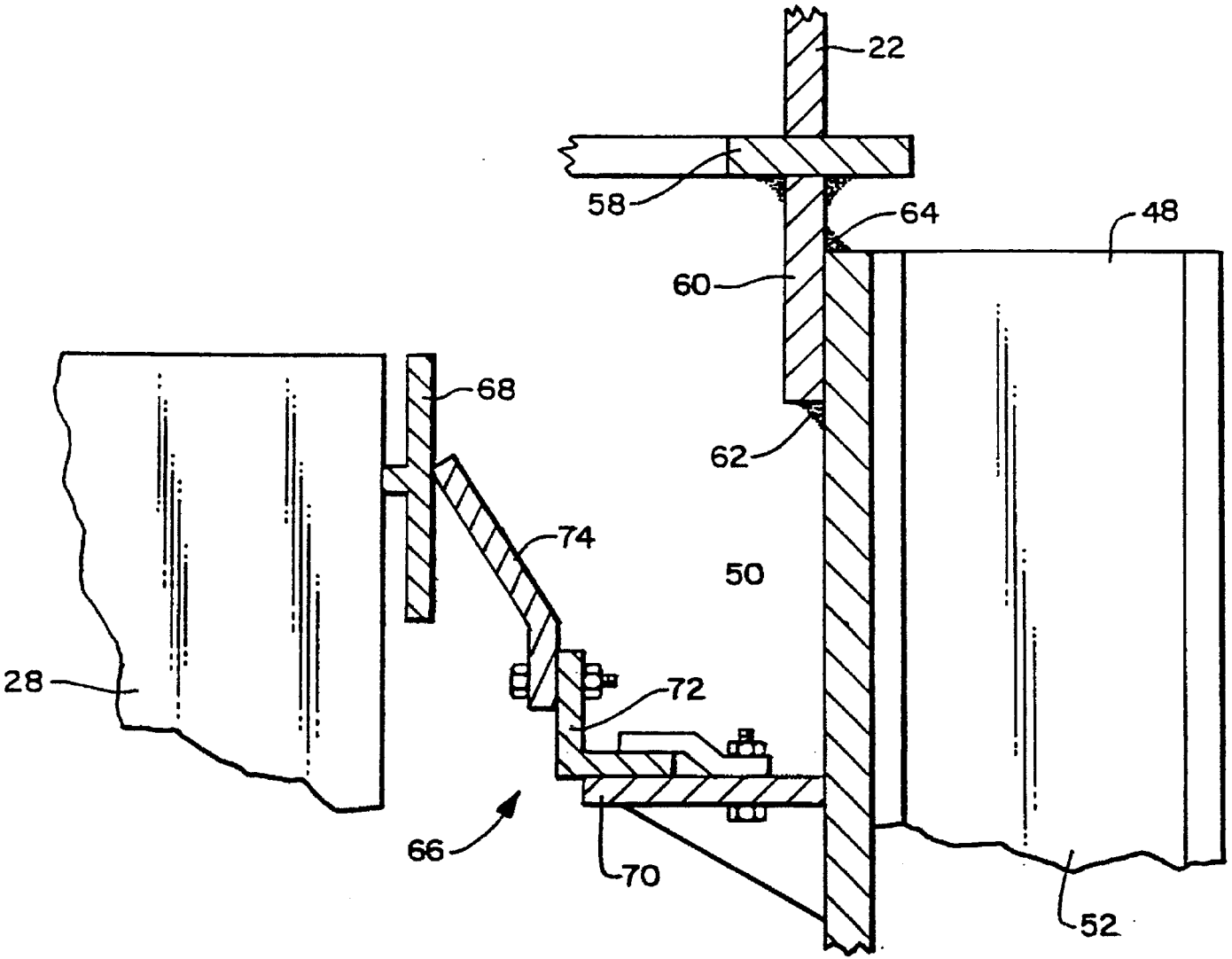
FIG. 4 is a more detailed view of the connection between the vertical housing panel and the hot end connecting plate duct assembly and of the bypass seal.

The hot end connecting duct assemblies 20 and 22 also have a horizontal flange plate 58 around the periphery similar to the flange 54. The alignment bars 60 are welded to and extend downwardly from this flange 58. The upper end of the vertical housing panels 48 are butted against these alignment bars 60 and welded in place as more clearly seen in FIG. 4 at 62 and 64. As can be seen in FIGS. 3 and 4, the length of the vertical housing panels 48 is no longer critical and only very wide tolerance need be maintained. This is because the vertical housing panels do not need to fit accurately between the flanges 54 and 58 as they did between the flanges 36 and 38 of the prior art arrangement shown in FIG. 2. The upper end of the panels now only needs to reach somewhere within the vertical height of the alignment bar 60 so that it can be attached and form a seal. Since this alignment bar 60 can be made as high as need be (within reasonable limits), the length of the vertical housing panels can vary widely and still be satisfactory.

FIG. 3 shows the bypass seals between the rotor 28 and the housing panels 48 which are generally designated 66 and which are similar to the bypass seals 44 of FIG. 2. The details of these bypass seals can most readily be seen in FIG. 4. Attached around the periphery of the top and bottom edges of the rotor 28 are the annular "T-bar" sealing surfaces 68. Attached to the inside of the vertical housing panel 48, generally near both the top and bottom ends of the rotor 28, are the inwardly extending brackets 70 which collectively form a generally annular-shaped bracket all around the rotor 28. Attached to the brackets 70 are the bypass seal angle brackets 72 which likewise collectively extend all the way around the rotor. Attached to the angle brackets 72 are the actual bypass seals 74 which may be of any conventional design. In general, these bypass seals 74 are flexible, circumferential members which are biased against the sealing surfaces 68 to form a gas and air tight seal. Although the upper bypass seal arrangement has been illustrated in FIG. 4, the lower bypass seal is usually the same or similar.

I claim:

1. A rotary regenerative heat exchanger having a top and a bottom and comprising:

a. a cold end center section at said bottom;

b. a hot end center section at said top;

c. at least one cold end connecting plate duct assembly attached to said cold end center section, said cold end connecting plate duct assembly having a periphery and including a cold end horizontal flange plate around said periphery;

d. at least one hot end connecting plate duct assembly attached to said hot end center section, said hot end connecting plate duct assembly having a periphery and including a hot end horizontal flange plate around said periphery;

e. a plurality of vertical housing panels forming a polygonal heat exchanger housing, said vertical housing panels supported on and extending upwardly from said cold end horizontal flange plate to a position proximate to and spaced below said hot end horizontal flange plate thereby forming a gap between said vertical housing panels and said hot end horizontal flange plate;

f. a plurality of lower vertical alignment bars attached to said cold end horizontal flange plate, each of said lower vertical alignment bars extending upwardly and being juxtaposed with the lower end of one of said vertical housing panels and attached thereto; and g. a plurality of upper vertical alignment bars attached to said hot end horizontal flange plate, each of said upper vertical alignment bars extending downwardly to a position juxtaposed with the upper end of one of said vertical housing panels thereby bridging said gap, said vertical housing panels being attached to said upper vertical alignment bars to seal said gap.

2. A rotary regenerative air preheater having a heat exchange rotor rotatably mounted on a vertical axis and having a cold end at the bottom thereof and a hot end at the top thereof and comprising:

a. a cold end center section extending across a portion of the cold end of said rotor and dividing said cold end into inlet and outlet sections;

b. a hot end section extending across a portion of the hot end of said rotor and dividing said hot end into inlet and outlet sections;

c. a cold end connecting plate duct assembly attached to each side of said cold end center section thereby forming cold end inlet and outlet duct assemblies, said cold end connecting plate duct assemblies including a cold end horizontal flange plate around the periphery thereof;

d. a hot end connecting plate duct assembly attached to each side of said hot end center section thereby forming hot end inlet and outlet duct assemblies, said hot end connecting plate duct assemblies including a hot end horizontal flange plate around the periphery thereof;

e. a plurality of vertical housing panels forming a polygonal heat exchanger housing, said vertical housing panels supported on and extending upwardly from said cold end horizontal flange plate to a position proximate to and spaced below said hot end horizontal flange plate thereby forming a gap between said vertical housing panels and said hot end horizontal flange plate;

f. a plurality of lower vertical alignment bars attached to said cold end horizontal flange plate, each of said lower vertical alignment bars extending upwardly and being juxtaposed with the lower end of one of said vertical housing panels and attached thereto; and g. a plurality of upper vertical alignment bars attached to said hot end horizontal flange plate, each of said upper vertical alignment bars extending downwardly to a position juxtaposed with the upper end of one of said vertical housing panels thereby bridging said gap, said vertical housing panels being attached to said upper vertical alignment bars to seal said gap.

3. A rotary regenerative air preheater as recited in claim 2 wherein said plurality of vertical housing panels are attached to said lower vertical alignment bars and said upper vertical alignment bars by welding.

4. A rotary regenerative air preheater as recited in claim 3 and further including sealing means between said rotor and said vertical housing panels.

5. A rotary regenerative air preheater as recited in claim 4 wherein said sealing means comprises:

a. an inwardly extending, generally annular shaped bracket attached to said vertical housing panels and extending around said rotor;

b. a sealing surface attached to and extending around said rotor;

c. a bypass seal attached to said bracket and extending around said rotor, said bypass seal positioned to slidably contact said sealing surface attached to said rotor.

6. A rotary regenerative air preheater as recited in claim 5 wherein said bypass seal is flexible.

7. A rotary regenerative air preheater as recited in claim 6 wherein said sealing means are positioned adjacent both said cold end of said rotor and said hot end of said rotor.

* * * * *